US005428860A

United States Patent [19]

Hurt

[11] Patent Number: 5,428,860

[45] Date of Patent: Jul. 4, 1995

[54] PORTABLE CLEANING AND WRINGING DEVICE FOR A MOP

[76] Inventor: David A. Hurt, 37-38 59th St., Woodside, N.Y. 11377

[21] Appl. No.: 293,303

[22] Filed: Aug. 22, 1994

[51] Int. Cl.[6] ..... A47L 13/60

[52] U.S. Cl. ..... 15/262; 15/260; 68/244; 68/245; 68/43; 68/205 R

[58] Field of Search ..... 15/260, 261, 262, 263; 68/43, 205 R, 205 D, 241, 244, 245

[56] References Cited

U.S. PATENT DOCUMENTS

| | | | |
|---|---|---|---|
| 1,015,450 | 1/1912 | McCloskey | 15/262 |
| 1,085,346 | 1/1914 | Lawlor | 15/262 |
| 1,407,122 | 2/1922 | Burke et al. | 15/262 |
| 1,935,157 | 11/1933 | Lisanti | 15/263 |
| 3,441,973 | 5/1969 | Turk | 15/262 |
| 3,611,758 | 10/1971 | Miller et al. | 68/205 D |
| 5,333,352 | 8/1994 | McDonald | 15/261 |

FOREIGN PATENT DOCUMENTS

| | | | |
|---|---|---|---|
| 30151 | 5/1907 | Germany | 15/262 |
| 24976 | of 1909 | United Kingdom | 15/263 |

*Primary Examiner*—Gary K. Graham
*Attorney, Agent, or Firm*—Michael I. Kroll

[57] ABSTRACT

A portable cleaning and wringing device for a mop having a mop head comprising a housing having an open top. A mop wringer mechanism is attached to the housing adjacent the open top. A component is for carrying the housing from place to place. An assembly is for cleaning the mop head when the mop head is being wrung out by the mop ringer mechanism, so as to prevent the mop head from becoming sour. The assembly can also be used for cleaning an area about the housing.

9 Claims, 2 Drawing Sheets

PORTABLE CLEANING AND WRINGING DEVICE FOR A MOP

BACKGROUND OF THE INVENTION

The instant invention is the subject matter of Disclosure Document No.: 341533, filed in the PTO on Oct. 25, 1993, and it is respectfully requested that this document be retained beyond the two-year period so that it may be relied upon as evidence of conception of the invention during the prosecution phase of this application, should the need arise.

1. Field of the Invention

The instant invention relates generally to mop wringers and more specifically it relates to a portable cleaning and wringing device for a mop.

2. Description of the Prior Art

Numerous mop wringers have been provided in prior art. For example U.S. Pat. Nos. 878,660 to McDonald; 1,015,450 to McCloskey; 1,162,403 to Schmoliner; 1,575,774 to Lawlor; 1,700,071 to Overraker; 1,787,441 to Finnell; 2,023,133 to Gringer; 2,080,945 to Lee; 2,328,797 to Fritsch et al.; 3,506,997 to Coraminas; 3,562,841 to Royalty; 3,921,247 to Cook; 4,720,879 to Rabban and 4,751,763 to Rose et al. all are illustrative of such prior art. While these units may be suitable for the particular purpose to which they address, they would not be as suitable for the purposes of the present invention as heretofore described.

A mop wringer comprising a frame having free end portions bent inwardly to form yielding supports. A roller frame is pivoted to the inturned end portions of the first named frame. A second roller frame is provided. A means is to yieldingly support the last named roller frame on the first named frame. Stops on the first named roller frame are arranged to engage the means when the roller is in its lowered position.

In wringing apparatus, the combination, with a frame adapted to be mounted on a scrubbing pail. A roller is rotatably carried by the frame. A cooperating, moveably-mounted roller is provided. A pivotally mounted journal bearing is for the second-mentioned roller. A pivotally mounted support is for the journal bearing.

In a mop wringer, the combination with a receptacle, of a relatively stationary roller arranged at the upper end of the receptacle. A relatively movable roller is arranged for movement toward and from the first mentioned roller. A pair of rockingly mounted members is for moving the relatively movable roller into and out of operative relation with the relatively stationary roller and is for automatically locking the same in operative position. One of the members is operatively connected with the relatively movable roller. The other is operatively connected with the relatively stationary roller. The free outer portions of the members are connected together.

In a mop wringer, the combination of a frame notched upon its upper edge. A clamping means is for attaching the frame to the upper edge of a pail. A roll is journaled on the frame. A bail is provided. A roll is journaled on the bail. The bail has projecting means received in the notches of the frame and forms a bearing member adjacent to the roll and is slideable upon the upper edge of the frame. A means embraces the sides of the frame and the adjacent arms of the bail for attaching the latter to the frame.

In a wringing apparatus, opposed side plates are provided with means for connecting the side plates to the rim of a pail. A roller having elongated trunnions formed on the ends thereof is slideably and rotatably journaled in the side plates. A member is for supporting a roller in cooperating relation with the first named roller. A means pivotally connects the supporting member to the side plates for relative movement to the first named roller. The connecting means is elongated to enable slideable movement of the side plates relative to the supporting member.

In a mop wringer having a wringer roller, a rocker having its axis substantially parallel with the axis of the roller for shifting the roller back and forth. A handle is for the rocker. A hinge is between the handle and rocker at substantially right angles to the latter. In one position the parts fixes the handle and rocker together against relative rotary rocking movement in one direction and provides for folding of the handle longitudinally of the rocker and substantially parallel with the axis of the roller.

A mop wringer including a plurality of rollers. Frame elements are for the individual rollers. Links interconnect adjacent ends of the frame elements, so that one of the latter is swingable to move its roller toward and away from the companion roller. The swingable frame element constitutes a lever. The links have stop association with a frame element to cause the rollers to be maintained in operative mop wringing relation with each other upon exerting a downward pressure on a frame element for causing its roller to move toward the companion roller. The swingable roller partially overlies the other roller. The frame elements and links are adapted to lie substantially in a plane upon swinging the moveable frame element into an inoperative position of the wringer. The leverage of the mop wringer is increased and the same is relatively free of any upward projecting parts in the open unoperated position of the wringer.

A mop wringer comprising a substantially rectangular frame having side and end bars formed of tubing. Supporting legs for the frame are hinged to and overlap the end bars of the frame. A stationary wringing roll is journaled in the side bars. Guide blocks are slideably fitted in the tubular side bars of the frame. A wringing roll is journaled in the guide blocks. Springs are connected to one of the end bars of the frame, are housed within the bores of the side bars of the frame and are connected to the guide blocks for holding the last named wringing roll spaced from the stationary wringing roll. Flexible connectors are secured to the guide blocks at the opposite ends thereof from the springs. A cross bar is connected to the flexible connectors. The cross bar forms a pedal. Guides on a pair of the legs slideably receive the ends of the pedal. Depression of the pedal moves the guide blocks to move the associated wringing roll toward the stationary wringing roll against the tension of the springs. A crank handle is connected to one of the wringing rolls for rotating the roll to feed the mop between the wringing rolls when the wringing rolls have been moved by the pedal and the connectors to an operative position to squeeze a mop between them.

A mop wringing apparatus for attachment to a pail, comprising in combination: a shiftable squeezing roller having a pressing area, and a cooperative squeezing roller likewise having a pressing area. The rollers are of equal length and each including axle stubs extending from opposite ends of each roller. A pair of mop guard rails are in the form of bent metallic straps. Each has a straight intermediate portion and a pair of angular mounting ears at opposite ends thereof for attachment of the rails in spanning relationship to the pail. The straight portions are spaced apart a lesser distance than the length of the roller pressing areas. Each of the rails has one of its ends provided with a substantially right angular outward bend and an adjacent rearward bend, to adapt the rails for accommodating between them the length of the second-mentioned cooperative squeezing roller. Bearing means on each rail adjacent to the rearward bend is for rotatably supporting the axle stubs of the cooperative squeezing roller and disposes the roller end peripheries in proximity with the outwardly bent portions of the rails, to avoid entanglement of mop strands with the axle stubs of the roller so supported. A means mounting the shiftable squeezing roller is for bodily movement arcuately toward and from the cooperative roller above the straight portions of the rails, with the axle stubs and marginal peripheral portions of the shiftable roller disposed outwardly of both rails.

Apparatus comprising a container for holding a cleaning fluid therein with a recess in the lower portion thereof. A cross bar extends across the recess, and upwardly on opposite sides of the container. It is pivotally connected to two L-shaped members disposed in opposite directions and is pivotally secured to the sides of the container. Wringer members are secured to the upper ends of the L-shaped members, so that depressing of the cross bar extending through the recess in the container will cause the wringer members to move toward each other and to extract water or cleansing fluid from a mop that is disposed between the wringer members.

A mop of the sponge-type material and a bucket provided with a squeeze plate for squeezing the mop. The mop and squeeze plate have a cooperating hook-type coupling about which the mop can be pivoted to squeeze it against the pressure plate by swinging the handle on the mop in an arcuate path.

A bucket has a mop wringer attachment comprising fixed and moveable rollers in a guide frame located in the bucket mouth. An S-shaped linkage and a yoke connects the moveable roller to an operating pedal. A stabilizing slot extends from the bucket wall below the pedal.

A utility sink with pull-through rollers is provided, having removable and repositionable compression surfaces which improve safety and efficiency in the mop wringing state of cleaning floor surfaces. A basin confines and saves cleaning liquids to soak the mops, and has snap pivot retainers that position pull-through rollers, so the user's thrust may be downward or away from his body while he stands in a safe and secure stance.

A mop bucket insert for maintaining a portion of a cleaning liquid contained in a bucket free of suspended solids. A platform spaced above the bottom of the bucket and side walls coupled with the platform substantially segregate solids which have settled in the compartment formed between the bucket bottom and platform, preventing suspension of these solids when a mop agitates the liquid. The platform provides a surface against which a cleaning instrument may be applied to remove solids entrained in the fibrous elements of the mop.

SUMMARY OF THE INVENTION

A primary object of the present invention is to provide a portable cleaning and wringing device for a mop that will revolutionize the process in which cleaning is done.

Another primary object of the present invention is to provide a portable cleaning and wringing device for a mop that will overcome the shortcomings of the prior art devices.

Another object is to provide a portable cleaning and wringing device for a mop that will clean the mop when the mop is wrung out by a mop wringer mechanism thereon, to prevent the mop from becoming sour.

An additional object is to provide a portable cleaning and wringing device for a mop that will clean the area about the device with a spray gun which is fluidly connected to a supply of detergent, disinfectant and fresh water.

A still additional object is to provide a portable cleaning and wringing device for a mop that will be stable and easy to conform to a toilet bowl, a sink and a bucket.

A further object is to provide a portable cleaning and wringing device for a mop that is simple and easy to use.

A still further object is to provide a portable cleaning and wringing device for a mop that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
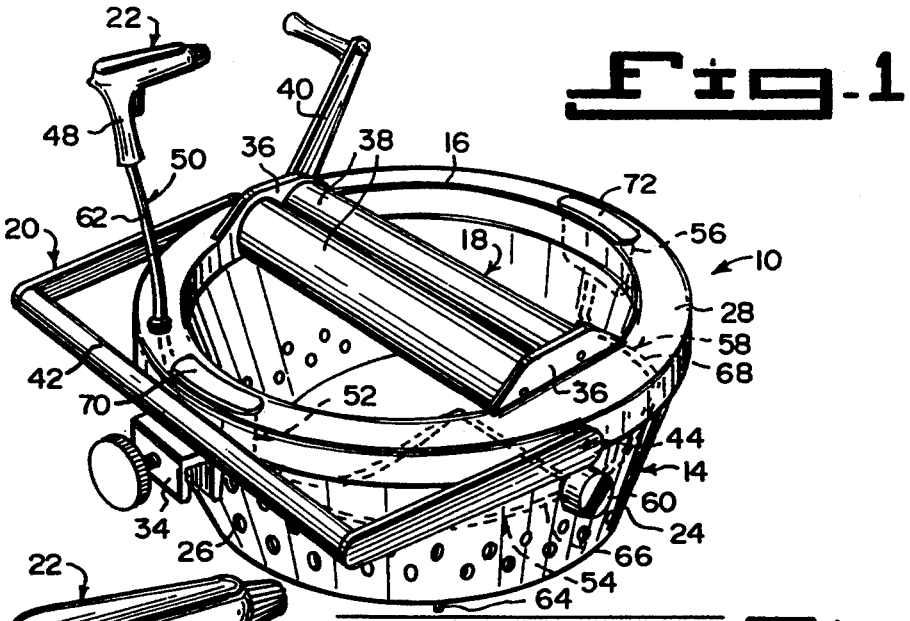
FIG. 1 is a perspective view of the instant invention per se.
Figure 2:
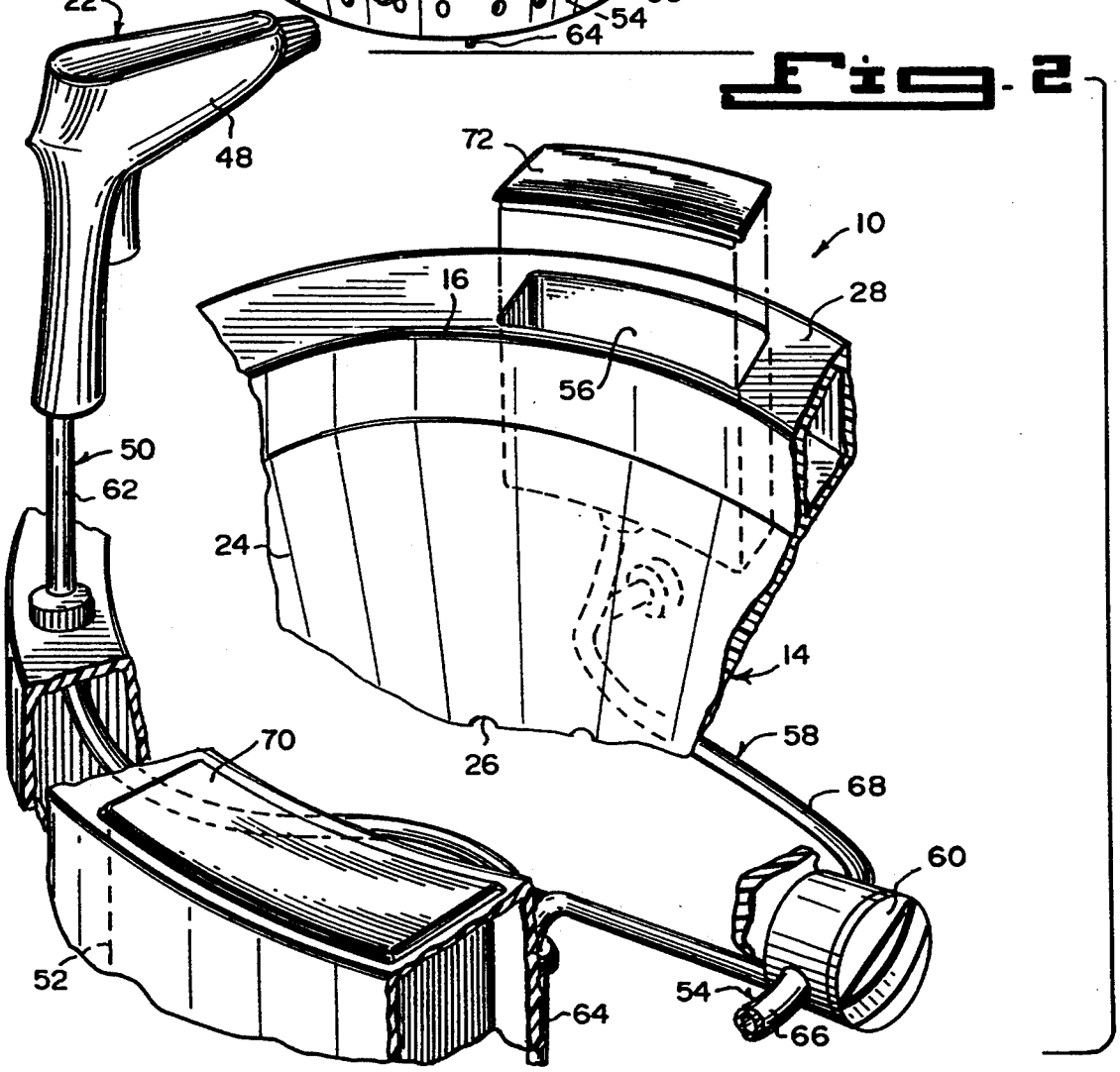
FIG. 2 is an enlarged perspective view with parts broken away and in section of the instant invention.
Figure 3:
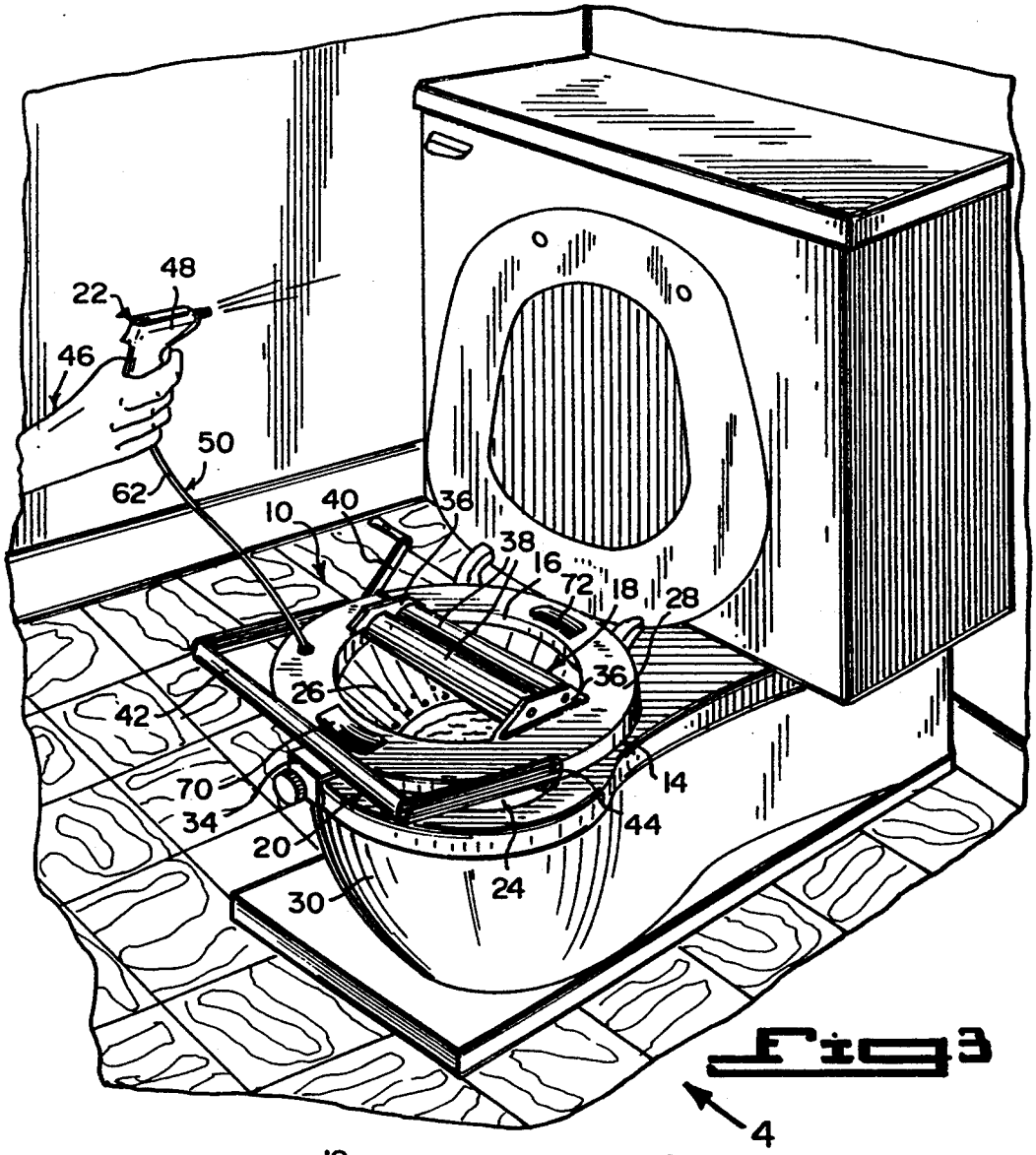
FIG. 3 is a perspective view of the instant invention placed into a bowl of a toilet.
Figure 4:
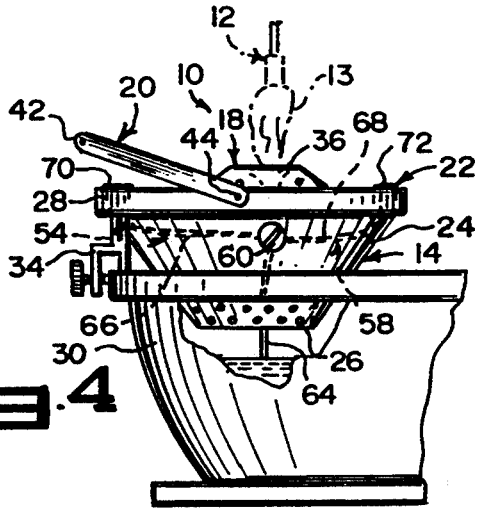
FIG. 4 is a right side view taken in the direction of arrow 4 in FIG. 3, with the toilet broken away and the bowl broken out.
Figure 5:
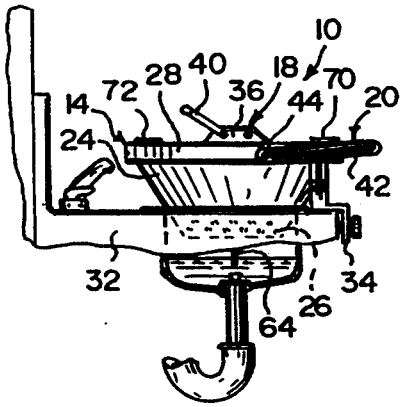
FIG. 5 is a left side view of the instant invention placed into a sink with the sink broken away and in section.

Turning now descriptively to the drawings, in which similar reference characters denote similar elements throughout the several views, FIGS. 1 through 5 illustrate a portable cleaning and wringing device 10 for a mop 12 having a mop head 13, comprising a housing 14 having an open top 16. A mop wringer mechanism 18 is attached to the housing 14 adjacent the open top 16. A component 20 is for carrying the housing 14 from place to place. An assembly 22 is for cleaning the mop head 13 when the mop head 13 is being wrung out by the mop wringer mechanism 18, so as to prevent the mop 12 from becoming sour. The assembly 22 can also be used for cleaning an area about the housing 14.

The housing 14 is an inverted frustrum conical wall 24 having a plurality of drain holes 26 therein, with an annular rib 28 about the open top 16. The housing 14 is sized to fit into a toilet bowl 30, a sink 32 and a bucket (not shown) and will be held thereto by an adjustable clamp 34 extending from the annular rib 28.

The mop wringer mechanism 18 includes a pair of spaced apart upstanding support brackets 36 on the annular rib 28 over the open top 16 of the housing 14. A pair of rollers 38 are rotatively mounted between the support brackets 36 in substantially parallel alignment with each other. The rollers 38 are disposed in a plane overlying the open top 16 of the housing 14 and are adapted for expelling water from the mop head 13 placed therebetween. A crank arm 40 is secured to an end of one roller 38 for rotating same.

The carrying component 20 is a handle 42 pivotally mounted at 44 to opposite sides of the annular rib 28, to enable a person 46 to carry the housing 14. The cleaning assembly 22 contains a spray gun 48 and a structure 50 for fluidly connecting a source of fresh water to the spray gun 48. The spray gun 48 can be manually operated by the person 46, to spray the water onto the mop head 13 and the area about the housing 14.

The cleaning assembly 22 further contains a first canister 52 with detergent built into the housing 14 through the annular rib 28. A structure 54 is for fluidly connecting the first canister 52 with the detergent to the spray gun 48. A second canister 56 with disinfectant is also built into the housing 14 through the annular rib 28. A structure 58 is for fluidly connecting the second canister 56 with the disinfectant to the spray gun 48. A mixing valve 60 mounted on an exterior surface of the wall 24 of the housing 14 is for selectively mixing the fresh water, the detergent and the disinfectant to the spray gun 48.

The first connecting structure 50 includes a retractable hose 62 on the spray gun 48 coupled to the mixing valve 60. A detachable hose 64 is coupled to the mixing valve 60 and extends through the housing 14 to the source of fresh water. The second connecting structure 54 is a first conduit 66 connected between the first canister 52 and the mixing valve 60. The third connecting structure 58 is a second conduit 68 connected between the second canister 56 and the mixing valve 60. The first canister 52 contains a child proof safety cap 70, so that the detergent can be replaced when needed. The second canister 56 also contains a child proof safety cap 72, so that the disinfectant can be replaced when needed.

LIST OF REFERENCE NUMBERS

10 portable cleaning and wringing device
12 mop
13 mop head on 12
14 housing
16 open top on 14
18 mop wringer mechanism
20 carrying component
22 cleaning assembly
24 inverted frustrum conical wall for 14
26 drain hole in 24
28 annular rib about 16
30 toilet bowl
32 sink
34 adjustable clamp on 28
36 upstanding support bracket on 28
38 roller
40 crank arm on 38
42 handle for 20
44 pivot for 42 on 28
46 person
48 spray gun
50 first connecting structure
52 first canister with detergent in 14
54 second connecting structure
56 second canister with disinfectant in 14
58 third connecting structure
60 mixing valve on exterior of 24
62 retractable hose for 50
64 detachable hose on 60
66 first conduit for 54
68 second conduit for 58
70 child proof safety cap on 52
72 child proof safety cap on 56

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A portable cleaning and wringing device for a mop having a mop head, said device comprising:

a) a housing having an open top, said housing being an inverted frustrum conical wall having a plurality of drain holes therein with an annular rib about said open top, said rib defining an inner and an outer side, said housing being sized to fit into a toilet bowl, a sink and a bucket and will be held thereto by an adjustable clamp extending from said annular rib;

b) a mop wringer mechanism attached to said housing adjacent said open top, said mop wringer mechanism including a pair of spaced apart upstanding support brackets on said annular rib over said open top of said housing, a pair of rollers rotatively mounted between said support brackets in substantially parallel alignment with each other, disposed in a plane overlying said open top of said housing and adapted for expelling water from the mop head placed therebetween, and a crank arm secured to an end of one said roller for rotating same;

c) means for carrying said housing from place to place; and d) means for cleaning the mop head when the mop head is being wrung out by said mop wringer mechanism, so as to prevent the mop head from becoming sour, whereby said means can be also used for cleaning area about said housing.

2. A portable cleaning and wringing device for a mop as recited in claim 1, wherein said carrying means is a handle pivotally mounted to said outer opposite sides of said annular rib to enable a person to carry said housing.

3. A portable cleaning and wringing device for a mop as recited in claim 2, wherein said cleaning means includes:

a) a spray gun; and b) means for fluidly connecting a source of fresh water to said spray gun, so that said spray gun can be manually operated by the person to spray the water onto the mop head and the area about said housing.

4. A portable cleaning and wringing device for a mop as recited in claim 3, wherein said cleaning means further includes:

a) a first canister with detergent built into said housing through said annular rib;

b) means for fluidly connecting said first canister with the detergent to said spray gun;

c) a second canister with disinfectant built into said housing through said annular rib;

d) means for fluidly connecting said second canister with the disinfectant to said spray gun; and e) a mixing valve mounted on an exterior surface of said wall of said housing, for selectively mixing the fresh water, the detergent and the disinfectant to said spray gun.

5. A portable cleaning and wringing device for a mop as recited in claim 4, wherein said first connecting means includes:

a) a retractable hose on said spray gun coupled to said mixing valve; and b) a detachable hose coupled to said mixing valve and extending through said housing to the source of fresh water.

6. A portable cleaning and wringing device for a mop as recited in claim 5, wherein said second connecting means is a first conduit connected between said first canister and said mixing valve.

7. A portable cleaning and wringing device for a mop as recited in claim 6, wherein said third connecting means is a second conduit connected between said second canister and said mixing valve.

8. A portable cleaning and wringing device for a mop as recited ic claim 7, wherein said first anistr includes a child proof safety cap, so that the detergent can be replaced when needed.

9. A portable cleaning and wringing device for a mop as recited in claim 8, wherein said second canister includes a child proof safety cap, so that the disinfectant can be replaced when needed.

* * * * *